United States Patent [19]

Graham

[11] 4,148,327

[45] Apr. 10, 1979

[54] WATER PIPE

[76] Inventor: Roger Graham, 721 Chesapeake Ave., Silver Spring, Md. 20910

[21] Appl. No.: 805,698

[22] Filed: Jun. 13, 1977

[51] Int. Cl.[2] ..... A24F 1/14

[52] U.S. Cl. ..... 131/173; 131/200

[58] Field of Search ..... 131/173, 178, 179, 180, 131/191, 200; D27/1-5

[56] References Cited

U.S. PATENT DOCUMENTS

| | | | |
|---|---|---|---|
| 3,881,499 | 5/1975 | McFadden et al. | 131/173 |
| 4,014,353 | 3/1977 | Kahler | 131/173 |
| 4,071,035 | 1/1978 | Boyd et al. | 131/173 |

FOREIGN PATENT DOCUMENTS

| | | | |
|---|---|---|---|
| 3771 | 6/1878 | Fed. Rep. of Germany | 131/173 |

*Primary Examiner*—Stephen C. Pellegrino

[57] ABSTRACT

A water pipe for smoking has two superposed water chambers with a tobacco chamber leading to the lower of said water chambers, a goose neck tubular element communicating with both water chambers, a carb hole between said water chambers and an outlet above the uppermost of said water chambers so that smoke from burning tobacco in said tobacco chamber can be drawn through both water chambers to said outlet to cool said smoke.

2 Claims, 3 Drawing Figures

WATER PIPE

BACKGROUND OF THE INVENTION

1. Field of the Invention

Related material can be found in U.S. Patent Classes D 27/1 to 5 & 51,131/173, 178, 179, 180, 185, 186, 191, 200, 201 and 128/185, 201 and 208.

2. Prior Art

Prior art known to applicant are the following U.S. Pat. Nos. D-199,607; 183,626; 1,545,220; D-230,099; 690,655; 1,579,703; D-230,775; 722,405; 1,690,609; 20,199; 809,325; 1,734,756; 39,987; 916,623; 1,826,331; 44,414; 1,244,410; 1,967,438; 46,505; 1,249,984; 2,815,030; 55,321; 1,372,544; 3,209,764; 77,096; 1,428,446; 3,703,179; 110,594; 1,513,147; 3,703,179.

BRIEF SUMMARY OF THE INVENTION

The present invention is a double water chamber smoking pipe having a one piece tubular body closed at its lower end and open at its top end with a detachable tobacco bowl mountable through the tubular body and leading to the lower one of said water chambers, a gooseneck tube detachably mounted in said body and communicating with both water chambers and a carb opening in said tubular body.

The tobacco is placed in said tobacco bowl and lit and the user initially closes said carb hole and draws on said tubular body open top end drawing smoke through both water chambers.

The principal object of the invention is to provide a water pipe having two cooling water chambers and which water pipe can be quickly and easily assembled of disassembled for cleaning.

BRIEF DESCRIPTION OF DRAWINGS

The accompanying drawings are a part of the application and.

DETAILED DESCRIPTION OF THE INVENTION

Figure 1:
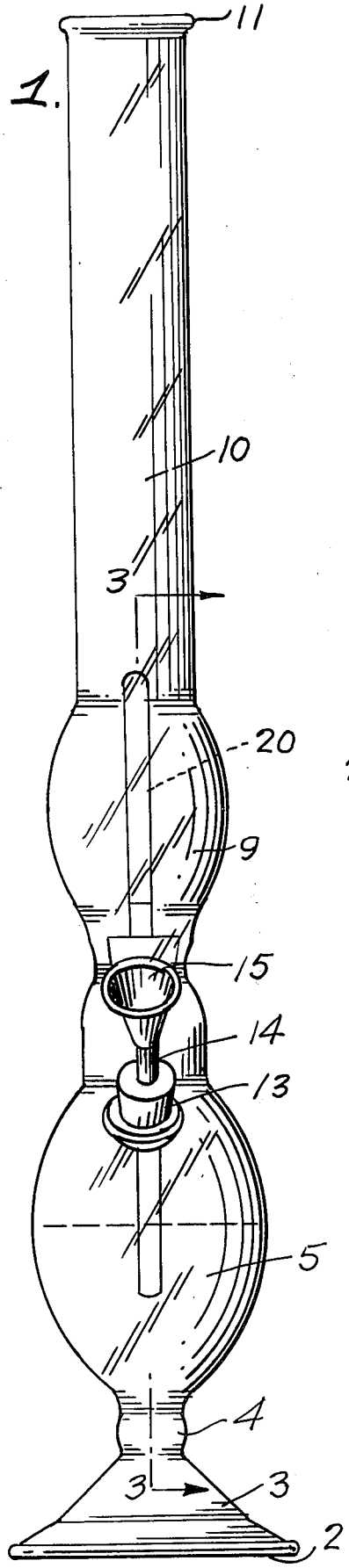
FIG. 1 is a side elevation of the present water pipe.

Referring now more particularly to the accompanying drawings, wherein like and corresponding parts are designated by the same reference characters, numeral 1 generally indicates a one-piece tubular body of glass, metal or plastic. Said body 1 has a flat closed bottom 2, inwardly tapering base 3, neck 4, bulbous lower water chamber 5, elongated necks 6 and 8 joined by a restricted portion 7, a second bulbous chamber 9 which provides the second and upper water chamber, an elongated tubular upper portion and bead 11 defining the open top of said tubular body.

Bulbous lower water chamber 5 has a side neck 11 providing a circular opening 12 in which is detachably inserted a tubular stopper 13. A tube 14 extends through stopper 13 to the lower portion of the lower water chamber 5 and has a bowl shaped exterior end 15 for receiving the tobacco to be smoked.

Neck 6 has a carb hole 16 therethrough for a purpose to be explained hereinafter.

A second tubular stopper 17 is detachably seated in the restricted portion 7 between necks 6 and 8. A gooseneck shaped tube 18-23 has a straight lower end section 18 extending through stopper 17, a slanting section 19, upwardly extending straight section 20, inverted U-shaped medial section 21 and downwardly extending straight section 22 whose open end is spaced above stopper 17. A bridge 23 connects sections 20 and 22 to strengthen the same.

MODE OF OPERATION OF INVENTION

With stoppers 13 and 17 removed from body 1, stopper 13 with tube 14 and bowl 15 mounted thereon, is inserted in opening 12 to the position shown in the drawings. The lower water chamber 5 is one-half filled with water A through the top opening of said tubular body. Then stopper 17 with goose-neck tube 18-23 mounted thereon is inserted in the center restricted portion 7 to the position shown in the drawings. The upper water chamber 9 is three-fourth filled with water B.

Then bowl 15 is filled with tobacco C, the user's thumb D is placed over carb hole 16, the tobacco is lit and the user draws through the open top of body 1 until the lower chamber water A is milky white. While still drawing on body 1, the user releases his thumb D from hole 16 and continues smoking.

To clean the water pipe between smokes, goose-neck tube 18–23 with stopper 17 is lifted from body 1 using a hook end of a hanger and stopper 13 with bowl 14–15 is detached from opening 12. Thereafter solid stoppers are placed in holes 12 and 16 and body 1 filled with detergent and a long handle bottle brush used to scrub chambers 5 and 9 clean. Thereafter stoppers 13 and 17 replace the stoppers in holes 12 and 16, respectively and use of the water pipe can be resumed.

Stoppers 13 and 17 can be of resilient material such as rubber, cork of the like and bowl 14–15 of glass, plastic or metal and similarly goose-neck tube 18–23 can be of glass, plastic or metal.

Figure 2:
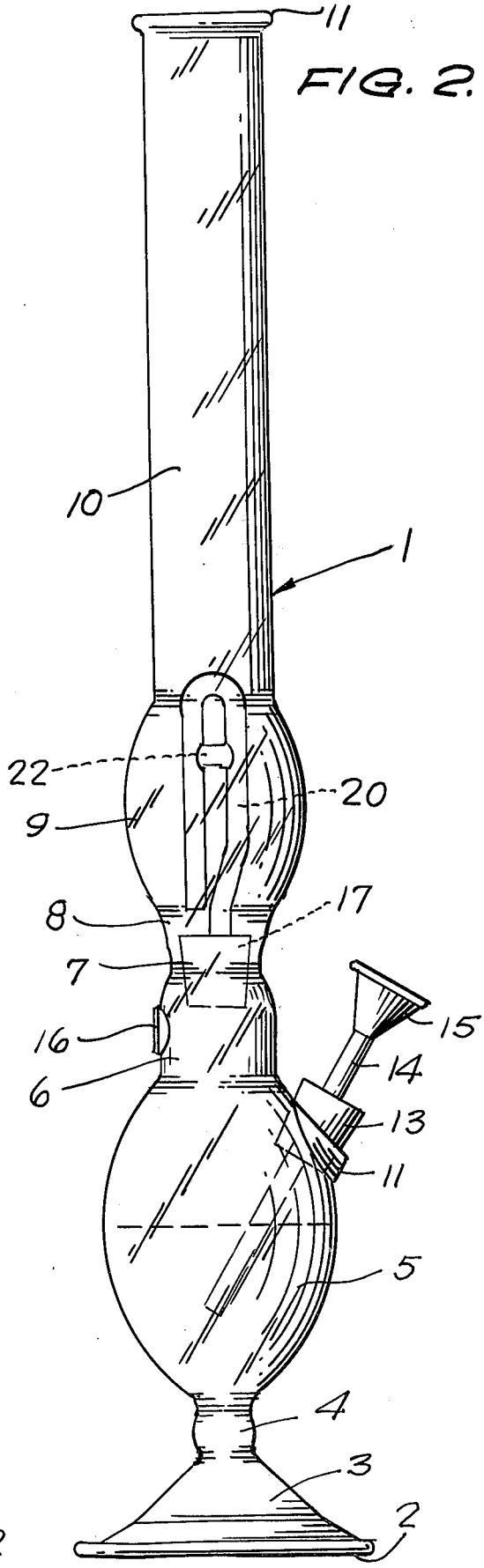
FIG. 2 is a front view taken from the left of FIG. 1.
Figure 3:
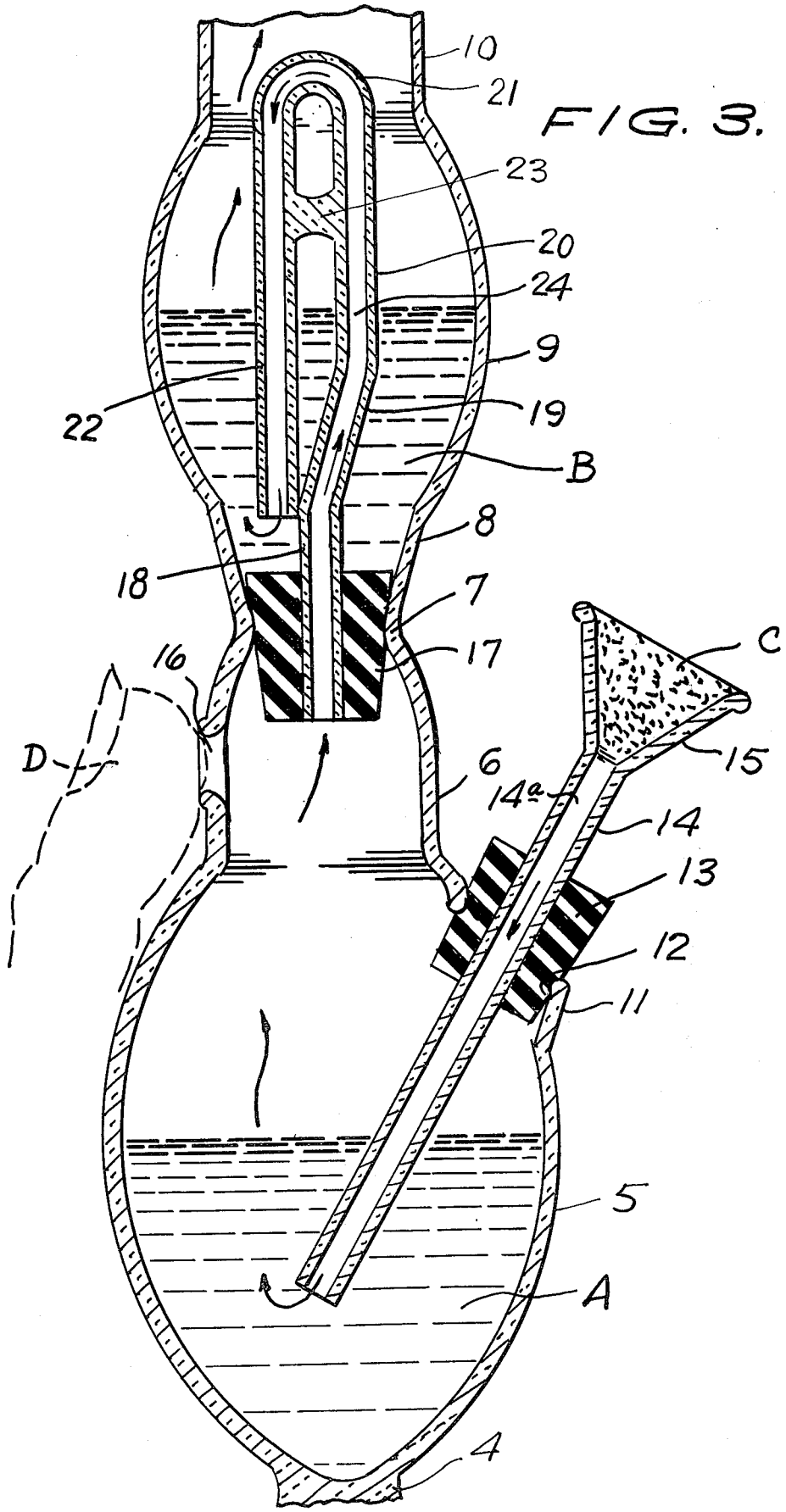
FIG. 3 is an enlarged partial cross-sectional view taken on line 3—3 of FIG. 1.

Preferably, body 1 is about twenty inches long from bottom 2 to bead 11 and head about one and half inches in diameter. The remaining portions and elements are relatively sized according to the proportions indicated in FIGS. 1 and 2.

I claim:

1. A water pipe for smoking comprising an elongated one-piece tubular body having a closed bottom end, a restricted open top end, a restricted intermediate portion, a bulbous portion between said bottom end and said restricted intermediate portion providing a lower water chamber, a pair of side openings in said body between said bottom end and said restricted intermediate portion, and a second bulbous portion between said restricted intermediate portion and said open top end providing an upper water chamber, a tubular stopper being mounted in one of said side openings, a bowl positioned exteriorly of said body and having a tubular portion extending through said stopper into said lower water chamber, a second tubular stopper being mounted in said restricted intermediate portion, a goose neck shaped tube being positioned in said second bulbous portion and having an end portion extending through said second stopper.

2. A water pipe as claimed in claim 1 wherein said tubular body has a neck between said first bulbous portion and said restricted intermediate portion and the other of said side openings is through said neck.

* * * * *